US009171189B2

(12) United States Patent
Tsividis et al.

(10) Patent No.: US 9,171,189 B2
(45) Date of Patent: Oct. 27, 2015

(54) SYSTEMS AND METHODS FOR PREVENTING SATURATION OF ANALOG INTEGRATOR OUTPUT

(71) Applicant: THE TRUSTEES OF COLUMBIA UNIVERSITY IN THE CITY OF NEW YORK, New York, NY (US)

(72) Inventors: Yannis Tsividis, New York, NY (US); Ning Guo, New York, NY (US)

(73) Assignee: THE TRUSTEES OF COLUMBIA UNIVERSITY IN THE CITY OF NEW YORK, New York, NY (US)

( * ) Notice: Subject to any disclaimer, the term of this patent is extended or adjusted under 35 U.S.C. 154(b) by 0 days.

(21) Appl. No.: 14/086,181

(22) Filed: Nov. 21, 2013

(65) Prior Publication Data

US 2014/0145759 A1 May 29, 2014

Related U.S. Application Data

(60) Provisional application No. 61/730,998, filed on Nov. 29, 2012.

(51) Int. Cl.
*G06G 7/186* (2006.01)

(52) U.S. Cl.
CPC ..... *G06G 7/1865* (2013.01)

(58) Field of Classification Search
None
See application file for complete search history.

(56) References Cited

U.S. PATENT DOCUMENTS

| | | | | |
|---|---|---|---|---|
| 4,562,424 | A * | 12/1985 | Takagi et al. | 341/166 |
| 4,873,661 | A * | 10/1989 | Tsividis | 708/801 |
| 4,924,412 | A * | 5/1990 | Leydier | 702/64 |
| 6,243,034 | B1 * | 6/2001 | Regier | 341/166 |
| 6,614,286 | B1 * | 9/2003 | Tang | 327/337 |
| 6,961,746 | B1 * | 11/2005 | Tang | 708/823 |
| 7,555,507 | B2 * | 6/2009 | Bryant et al. | 708/6 |

OTHER PUBLICATIONS

R. L. Geiger and E. Sánchez-Sinencio, "Active Filter Design Using Operational Transconductance Amplifiers: A Tutorial," IEEE Circuits and Devices Magazine, vol. 1, pp. 20-32, Mar. 1985.*

* cited by examiner

*Primary Examiner* — Alexander H Taningco
*Assistant Examiner* — Nelson Correa
(74) *Attorney, Agent, or Firm* — Wilmer Cutler Pickering Hale and Dorr LLP

(57) ABSTRACT

Systems and methods for preventing saturation of analog integrator outputs are provided. Applications of the systems and methods in hybrid analog-digital integrators are also provided. Exemplary systems include two switches, one operational amplifier, one capacitor C, four gain blocks, three comparators, one XOR gate, one OR gate, one T flip-flop, and one digital counter.

26 Claims, 2 Drawing Sheets

SYSTEMS AND METHODS FOR PREVENTING SATURATION OF ANALOG INTEGRATOR OUTPUT

CROSS REFERENCE TO RELATED APPLICATIONS

This application claims priority under 35 U.S.C. §119(e) of U.S. Provisional Application No. 61/730,998, filed Nov. 29, 2012, entitled "SYSTEMS AND METHODS FOR PREVENTING SATURATION OF ANALOG INTEGRATOR OUTPUT," the entire contents of which are incorporated by reference herein in their entirety.

BACKGROUND

The analog integrator is a fundamental component in numerous important electronic devices such as analog-to-digital converters (ADCs), control systems, and analog computers. Analog integrators produce output signals that are the time integrals of their input signals. Input signals with high amplitudes may cause conventional analog integrators to produce an output that saturates at the circuit's supply voltage and therefore does not accurately reflect the integral of the input. If not designed properly or carefully, a conventional analog integrator may produce incorrect results given certain input signals because of saturation of its output at the value of its supply voltage. Such saturation could cause errors or inaccuracies.

U.S. Pat. No. 7,555,507 to Bryant et al. ("Bryant") discloses a technique to prevent the saturation of analog integrator's output. When the output of the analog integrator reaches the threshold voltage, a pre-charged capacitor will be used to reset the output, forcing the output to go to zero. Thus, there would be a sudden discharge for the capacitor of the analog integrator.

SUMMARY

According to aspects of the present disclosure, a mixed signal analog-digital integrator prevents saturation by reversing the integrator's output. It reverses the circuit's input signal when its output reaches a threshold voltage. A digital counter, which is adjusted when the threshold is reached, tracks the digital integer part of the output integral value and combines it with the value of the analog portion of the circuit to produce an accurate output. This design obviates the need for capacitor-based output resets that increase circuit power requirements and introduce noise.

Therefore, in contrast to Bryant, when the output of the analog integrator reaches the threshold voltage, the disclosed systems reverse the input signal. Then, the integrator would integrate a reversed input and the output will go in the opposite direction, preventing the saturation. Thus, the disclosed systems do not suffer from any sudden discharge of the capacitor, thereby reducing noise.

Compared with conventional integrators and conventional methods for preventing saturation, the present system results in no sudden discharge of a capacitor. This feature reduces the need for fast discharge, thereby reducing the power dissipation, because no charge is wasted by discharging; reducing the problems associated by preserving sharp transitions; and reducing the associated noise.

DETAILED DESCRIPTION

Systems and methods for preventing saturation of analog integrator outputs are provided. Applications of the systems and methods in hybrid analog-digital integrators are also provided. According to aspects of the present disclosure, a mixed signal analog-digital circuit stores part of the integral being computed in a digital counter and computes the remaining fractional part with an analog integrator.

The present design obviates the need for capacitor-based output resets. Instead, the input signal is reversed and the digital counter is adjusted when the output reaches a threshold value so as to switch the integrating direction of the output. This prevents the integrator's output from saturation. By preventing saturation, the disclosed systems enable an integrator to produce the integral of input signals whose number range is now not limited by its supply voltage.

In contrast to conventional saturation prevention methods, the present system obviates the need to employ a capacitor-based output reset mechanism. This reduces the power dissipation of the circuit and eliminates a potential source of noise.

The disclosed systems can address integrator saturation problems in contexts where the use of capacitor-based resets might be problematic.

Because the use of mixed signal design of the technology renders the digital portion of the integral resistant to noise, the disclosed systems may be particularly useful in situations where electronic noise might adversely affect the performance of conventional integrators.

By reducing the need to constrain or scale an integrator's input signal magnitude to prevent saturation, the disclosed systems can simplify the design of certain circuits that require integrators.

This circuit and method are developed to prevent the saturation of the analog integrator's output and store the integration results.

Figure 1:
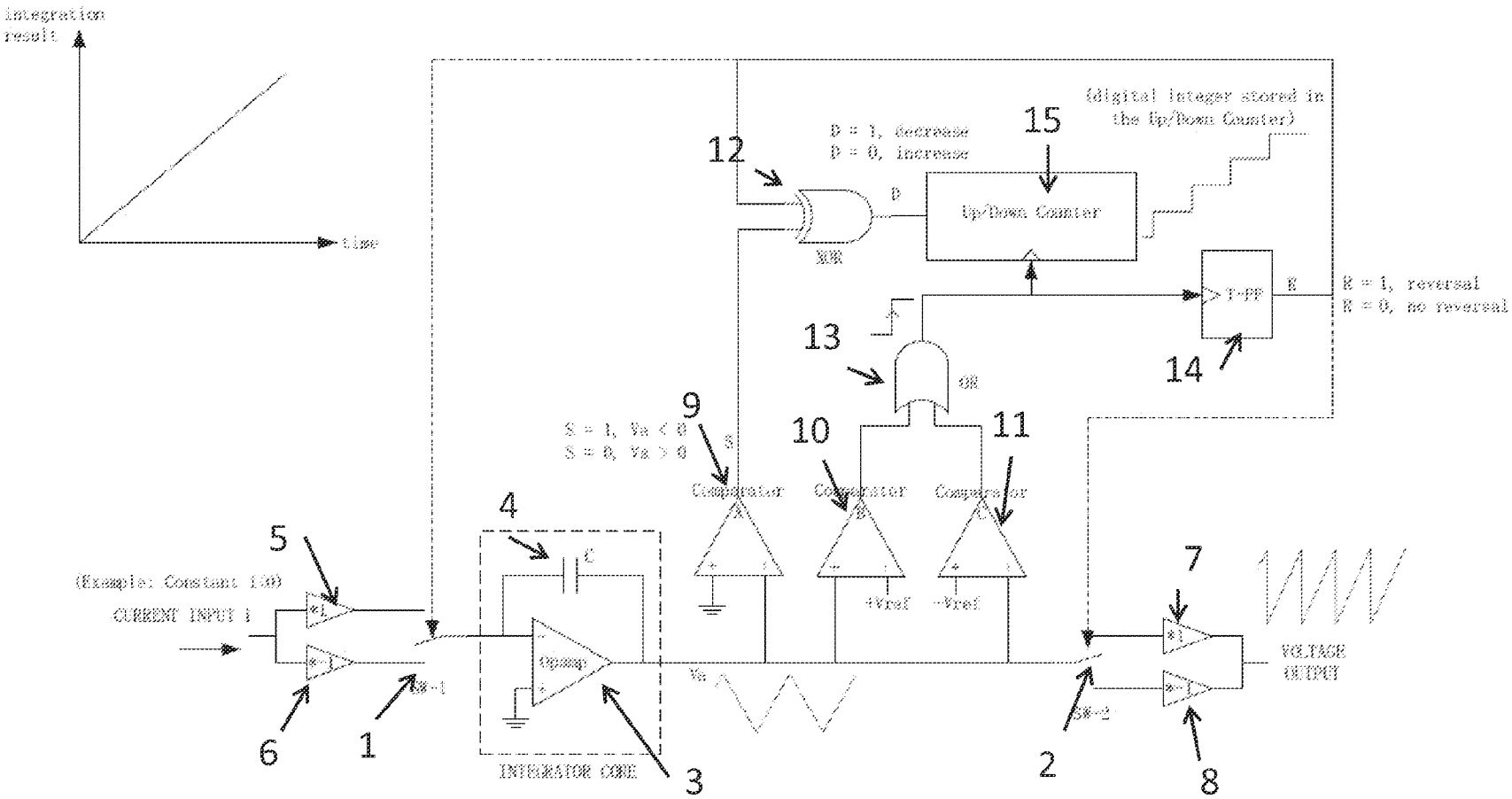
FIG. 1 shows an implementation of a system for preventing saturation of an analog integrator output, according to aspects of the present invention.

FIG. 1 shows one exemplary implementation of the systems and methods according to aspects of the present disclosure. The exemplary system of FIG. 1 includes two single pole, double throw (SPDT) switches "SW-1" (1), "SW-2" (2), one operational amplifier "Opamp" (3), one capacitor C (4), four gain blocks (*1, *−1) (5-8), three comparators Comparator A (9), Comparator B (10), Comparator C (11), one two-input XOR gate (12), one two-input OR gate (13), one T flip-flop (14), and one digital Up/Down Counter: Up/Down Counter (15).

The operational amplifier Opamp with the capacitor C (4) in feedback forms a conventional analog integrator. The exemplary implementation of FIG. 1 has dual rail supplies.

According to exemplary aspects of the present invention, whenever the analog integrator's output Va reaches the threshold voltages (+Vref and −Vref) of the two comparators (Comparator B and Comparator C), a rising edge will be generated and sent into Up/Down Counter and the T flip-flop (T-FF). This rising edge will trigger the Up/Down Counter and T-FF: the Up/Down Counter will increase/decrease and the T-FF will toggle its output. The output of the T-FF is named R, which means "reverse". The signal R controls, as shown by the dashed lines in FIG. 1, the positions of the two SPDT switches: when R=1, the two SPDT switches will connect the *−1 gain blocks, meaning the input signal is reversed in sign; when R=0, the two SPDT switches will connect the *1 gain blocks, meaning the input signal is not reversed. The output of Comparator A is named S, which decides the sign of the integrator output Va: when S=1, Va<0; when S=0, Va>0.

The signals S and R are fed into an XOR gate. The output of XOR is connected to the port D of the Up/Down Counter. Thus, signal D=R XOR S. When D=1, the Up/Down Counter is in decrease mode; when D=0, the Up/Down Counter is in increase mode.

The least significant bit (LSB) of the Up/Down Counter represents a value of 2. For example, the counter has four digital bits D3D2D1D0 and D0 is the LSB. If D3D2D1D0=0101, the integer stored in the counter is: 0*2^4+1*2^3+0*2^2+1*2^1=10.

The equation below can interpret the integration results stored in the disclosed systems:

$$\text{Integration result}=(\text{digital integer stored in the Up/Down Counter})*V\text{ref}+(-1)^{R}*Va$$

The circuit shown in FIG. 1 is a single-ended version of this method. A more general case may include a fully differential implementation. In the fully differential implementation, the reversal of the input/output signal is simply interchanging the two input/output terminals.

The integrator in FIG. 1 is shown to include an operational amplifier. It is to be understood that other techniques can be used to implement an integrator, for example a transconductor and a capacitor.

Figure 2:
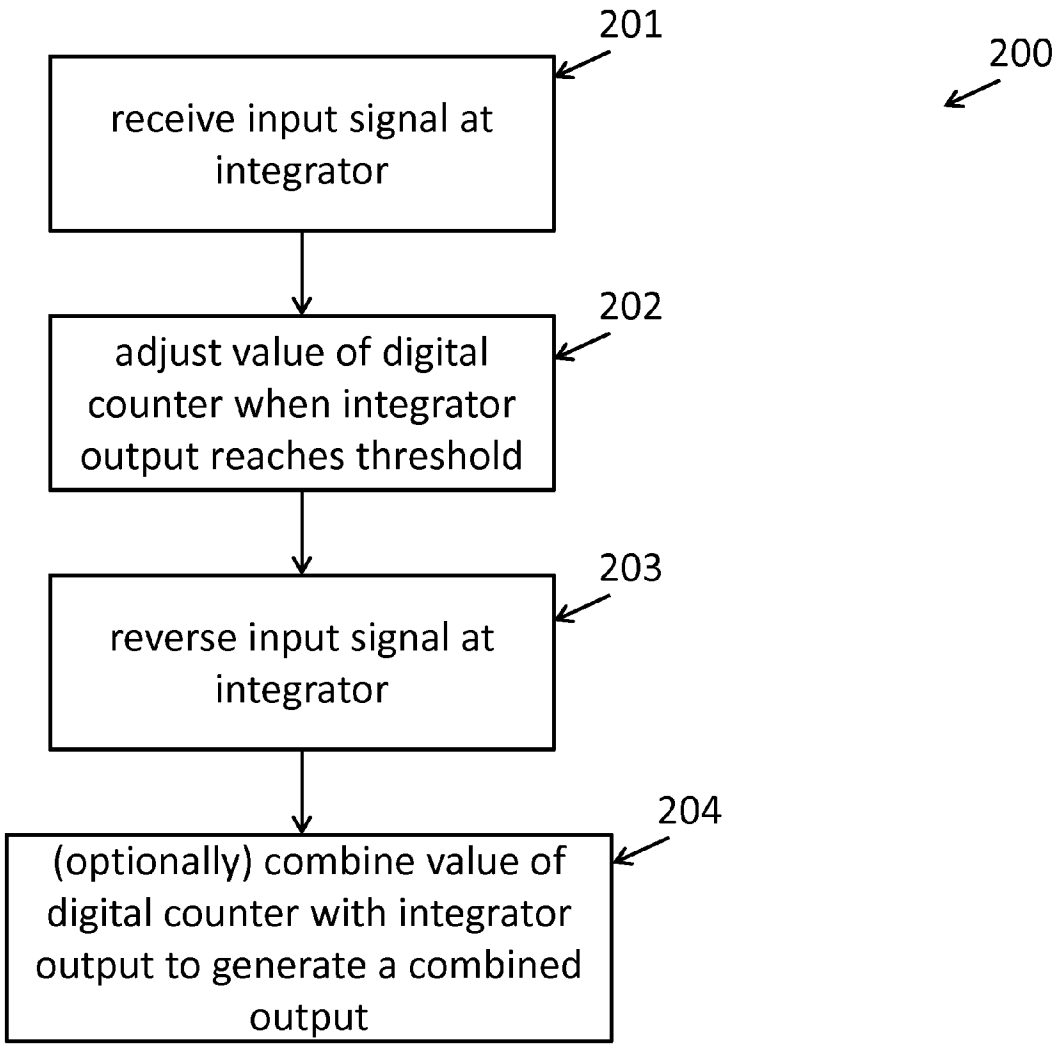
FIG. 2 shows a method for preventing saturation of an analog integrator output, according to aspects of the present invention.

FIG. 2, generally at 200 shows an exemplary method for preventing saturation of an integrator output. At 201 the integrator receives an input signal 201. When the integrator output reaches a threshold, the value of a digital counter is adjusted 202, for example, increased by one, and the input signal at the integrator is reversed 203, to prevent saturation. Therefore, the digital counter stores the integer part of the value. To generate an accurate result, the value of the digital counter may be optionally combined with the integrator output to generate a combined result 204. In some applications, the value of the digital counter and the integrator output value are kept separate.

Although the invention has been described and illustrated in the foregoing illustrative embodiments, it is understood that the present disclosure has been made only by way of example, and that numerous changes in the details of implementation of the invention can be made without departing from the spirit and scope of the invention. Features of the disclosed embodiments can be combined and rearranged in various ways.

What is claimed is:

1. A system for preventing saturation of an integrator output comprising:

an integrator receiving an input signal and generating an output, the integrator comprising:

an operational amplifier having a first input and an output; and a capacitor coupling the output of the operational amplifier with the first input of the operational amplifier;

a digital counter having a value and configured to adjust the value of the digital counter when an output of the integrator reaches a threshold;

a first switch coupling the input signal to the first input of the operational amplifier; and a first comparator having a first input coupled to the output of the operational amplifier, a second input coupled to ground, and an output coupled to a first input of an XOR gate;

wherein the input signal is reversed by the first switch when the output of the integrator reaches the threshold;

wherein the digital counter combines the value of the digital counter with the output of the integrator to generate a combined output.

2. The system of claim 1, comprising a second comparator having a first input coupled to a first reference voltage, a second input coupled to the output of the operational amplifier, and an output coupled to a first input of an OR gate.

3. The system of claim 2, comprising a third comparator having a first input coupled to the output of the operational amplifier, a second input coupled to a second reference voltage, and an output coupled to a second input of the OR gate.

4. The system of claim 3, wherein the digital counter is coupled to the output of the XOR gate and the OR gate.

5. The system of claim 4, comprising a T-flip flop having an input coupled to the output of the OR gate and an output coupled to a second input of the XOR gate.

6. The system of claim 5, comprising a second switch coupling the output of the operational amplifier to an output of the system;

wherein the first switch and the second switch are controlled by the signal of the output of the T-flip flop.

7. The system of claim 6, wherein the first input of the first comparator is a negative input of the first comparator and the second input of the first comparator is a positive input of the first comparator.

8. The system of claim 7, wherein the first input of the second comparator is a negative input of the second comparator and the second input of the second comparator is a positive input of the second comparator.

9. The system of claim 8, wherein the first input of the third comparator is a negative input of the third comparator and the second input of the third comparator is a positive input the first comparator.

10. The system of claim 9, wherein the first reference voltage has a positive amplitude and the second reference voltage has a negative amplitude.

11. The system of claim 10, wherein a second input of the operational amplifier is coupled to ground.

12. The system of claim 11, wherein the first input of the operational amplifier is a negative input of the operational amplifier and the second input of the operational amplifier is a positive input of the operational amplifier.

13. The system of claim 1, wherein the integrator comprises a transconductor and a capacitor.

14. A method for preventing saturation of an integrator output comprising:

providing an integrator receiving an input signal and generating an output;

adjusting a value of a digital counter when the output of the integrator reaches a threshold;

reversing the input signal when the output of the integrator reaches the threshold;

combining the value of the digital counter with the output of the integrator to generate a combined output; and providing a first comparator having a first input coupled to the output of the operational amplifier, a second input coupled to ground, and an output coupled to a first input of an XOR gate;

wherein the integrator comprises:

an operational amplifier having a first input and an output; and a capacitor coupling the output of the operational amplifier with the first input of the operational amplifier;

wherein the input signal is reversed by a first switch that couples the input signal to the first input of the operational amplifier.

15. The method of claim 14, further comprising providing a second comparator having a first input coupled to a first reference voltage, a second input coupled to the output of the operational amplifier, and an output coupled to a first input of an OR gate.

16. The method of claim 15, further comprising providing a third comparator having a first input coupled to the output of the operational amplifier, a second input coupled to a second reference voltage, and an output coupled to a second input of the OR gate.

17. The method of claim 16, wherein the digital counter is coupled to the output of the XOR gate and the OR gate.

18. The method of claim 17, further comprising providing a T-flip flop having an input coupled to the output of the OR gate and an output coupled to a second input of the XOR gate.

19. The method of claim 18, further comprising providing a second switch coupling the output of the operational amplifier to an output of the system;

wherein the first switch and the second switch are controlled by the signal of the output of the T-flip flop.

20. The method of claim 19, wherein the first input of the first comparator is a negative input of the first comparator and the second input of the first comparator is a positive input of the first comparator.

21. The method of claim 20, wherein the first input of the second comparator is a negative input of the second comparator and the second input of the second comparator is a positive input of the second comparator.

22. The method of claim 21, wherein the first input of the third comparator is a negative input of the third comparator and the second input of the third comparator is a positive input the first comparator.

23. The method of claim 22, wherein the first reference voltage has a positive amplitude and the second reference voltage has a negative amplitude.

24. The method of claim 23, wherein a second input of the operational amplifier is coupled to ground.

25. The method of claim 24, wherein the first input of the operational amplifier is a negative input of the operational amplifier and the second input of the operational amplifier is a positive input of the operational amplifier.

26. The method of claim 14, wherein the integrator comprises a transconductor and a capacitor.

* * * * *